US011708717B2

(12) United States Patent
Minaudo

(10) Patent No.: US 11,708,717 B2
(45) Date of Patent: Jul. 25, 2023

(54) DRAFT GUARD APPARATUS AND METHOD

(71) Applicant: Jesse John Minaudo, Beaverton, MI (US)

(72) Inventor: Jesse John Minaudo, Beaverton, MI (US)

( * ) Notice: Subject to any disclaimer, the term of this patent is extended or adjusted under 35 U.S.C. 154(b) by 0 days.

(21) Appl. No.: 17/234,600

(22) Filed: Apr. 19, 2021

(65) Prior Publication Data

US 2021/0372193 A1 Dec. 2, 2021

Related U.S. Application Data

(63) Continuation-in-part of application No. 16/873,632, filed on May 26, 2020, now abandoned.

(51) Int. Cl.

| | |
|---|---|
| ***E06B 9/52*** | (2006.01) |
| ***E06B 3/26*** | (2006.01) |
| ***E06B 3/263*** | (2006.01) |
| *E06B 9/24* | (2006.01) |

(52) U.S. Cl.

CPC ..... *E06B 3/26303* (2013.01); *E06B 9/24* (2013.01); *E06B 9/52* (2013.01)

(58) Field of Classification Search

CPC ..... E06B 3/26; E06B 3/26303; E06B 3/30; E06B 3/305; E06B 3/306; E06B 7/098; E06B 7/205; E06B 7/21; E06B 7/26; E06B 2009/002; E06B 9/52; E06B 9/521; E06B 9/24; F24B 1/192; F24B 1/198; E04B 1/72

See application file for complete search history.

(56) References Cited

U.S. PATENT DOCUMENTS

| | | | | |
|---|---|---|---|---|
| 3,042,111 A * | 7/1962 | Wytovich | B60J 11/08 160/370.21 |
| 3,133,324 A * | 5/1964 | Foreman | E06B 7/2314 49/260 |
| 3,805,872 A * | 4/1974 | Lorber | E06B 9/52 160/354 |
| 3,894,527 A * | 7/1975 | Ickes | F24B 1/192 49/478.1 |
| 3,965,599 A * | 6/1976 | Ebner | G09F 7/04 40/711 |

(Continued)

FOREIGN PATENT DOCUMENTS

KR 20100011483 11/2010

OTHER PUBLICATIONS

Northants Windows, "How to Insulate Windows for Winter," https://www.northantswindows.com/insulate-windows-winter/.

(Continued)

*Primary Examiner* — Kyle J. Walraed-Sullivan

(57) ABSTRACT

A kit for sealing an architectural opening, such as a window or a door, is provided. The kit includes a clear vinyl sheet having a thickness of at least 1 millimeter and a magnetic strip. An adhesive backing extends along one side of the magnetic strip such that the magnetic strip is adhesively mountable to the vinyl sheet. The kit enables a consumer to easily seal the architectural opening by adhering the magnetic strip to the vinyl sheet, and then magnetically attaching the sheet over the architectural opening, thereby sealing the opening. The thickness and material of the sheet provides enhanced ease of use and durability.

8 Claims, 4 Drawing Sheets

(56) References Cited

U.S. PATENT DOCUMENTS 4,249,589 A * 2/1981 Loeb ..... E06B 3/285 160/354
4,387,541 A 6/1983 Boomershine
4,409,758 A * 10/1983 Dickerson ..... E06B 3/28 160/369
4,473,980 A 10/1984 Foster
4,510,986 A * 4/1985 Schwankl ..... E06B 3/285 160/354
4,562,675 A * 1/1986 Baigas, Jr ..... E06B 3/285 160/354
4,603,724 A * 8/1986 Borwick ..... E06B 7/32 160/180
4,802,523 A * 2/1989 Scholten ..... F16B 5/00 160/354
4,836,265 A * 6/1989 Bussert ..... A47H 99/00 160/354
4,909,299 A * 3/1990 Bussert ..... E06B 9/24 160/354
4,971,130 A * 11/1990 Bentley ..... E06B 9/521 160/368.1
5,282,504 A * 2/1994 Anderson ..... E06B 9/52 49/64
5,421,112 A * 6/1995 Knorr ..... G09F 7/04 40/605
5,479,984 A * 1/1996 Easterbrook ..... F24F 13/08 454/289
D396,001 S * 7/1998 Crumpler ..... D23/405
6,073,675 A * 6/2000 Dannaher ..... E06B 9/52 160/354
6,257,307 B1 * 7/2001 Tollivar ..... E06B 9/52 160/354
6,298,844 B1 * 10/2001 Skinkiss ..... F24B 1/192 126/545
8,261,736 B1 * 9/2012 Olivarri ..... A47G 5/04 160/369
8,464,447 B2 * 6/2013 Pemberton ..... G09F 7/04 40/661.01
8,484,896 B1 * 7/2013 Skubiak, Jr. ..... E06B 9/52 160/369
11,053,730 B1 * 7/2021 Camarillo ..... E06B 9/24
2002/0170554 A1 * 11/2002 Behn ..... F24B 1/192 126/547
2003/0186604 A1 * 10/2003 Nourigat ..... A01M 1/04 428/114
2004/0211531 A1 * 10/2004 Dybdahl ..... E06B 9/24 160/377
2005/0045284 A1 * 3/2005 Ullyett ..... E06B 9/78 160/238
2005/0173078 A1 * 8/2005 Perez ..... A01K 1/035 160/99
2008/0284596 A1 * 11/2008 Montague ..... G08B 13/19697 340/545.8
2009/0133342 A1 * 5/2009 Copeland ..... E04B 9/003 52/404.1
2009/0183844 A1 * 7/2009 Alkhoury ..... E06B 9/52 160/369
2009/0249705 A1 * 10/2009 Struthers ..... H04R 1/026 33/290
2010/0236159 A1 * 9/2010 Hyer ..... E04F 13/002 52/511
2011/0030294 A1 * 2/2011 Clarson ..... E06B 7/08 52/203
2011/0239557 A1 * 10/2011 Bowie ..... A01M 29/32 14/74
2012/0311934 A1 * 12/2012 Abramson ..... E06B 7/26 49/506
2013/0321715 A1 * 12/2013 Millson ..... F16M 11/048 52/27
2015/0159425 A1 * 6/2015 Algar ..... E06B 7/28 24/303
2015/0219339 A1 * 8/2015 Maxson ..... F24B 1/1885 126/523
2016/0047117 A1 * 2/2016 DeRita ..... E04B 2/7457 52/745.1
2016/0273261 A1 * 9/2016 Pardue ..... E06B 3/301
2016/0326766 A1 * 11/2016 Miceli ..... H01F 7/0252
2017/0128868 A1 * 5/2017 Simmons ..... E06B 9/52
2019/0048649 A1 * 2/2019 Koenitz ..... E06B 1/32
2019/0071924 A1 * 3/2019 Seaman ..... E06B 9/24
2020/0270886 A1 * 8/2020 Guilfoyle ..... A61H 33/6005
2022/0075098 A1 * 3/2022 Mabry ..... B05D 5/06

OTHER PUBLICATIONS

Apex Magnets, "Use Magnets to Winter-Proof Your Home," https://www.apexmagnets.com/news-how-tos/use-magnets-to-winter-proof-your-home/.
Everyday Crafty Goodness, "Resealable (Cat Proof) Magnetic Window Insulation Tutorial," https://everydaycranygoodness.wordpress.com/2007/11/27/resealable-cat-proof-magnetic-window-insulation-tutorial/.

* cited by examiner

DRAFT GUARD APPARATUS AND METHOD

CROSS-REFERENCE TO RELATED APPLICATION

This application is a continuation in part of U.S. patent application Ser. No. 16/873,632, filed May 26, 2020, and which is hereby incorporated by reference in its entirety.

TECHNICAL FIELD

This disclosure relates generally to the field window and door insulation.

BACKGROUND

Poorly sealed or poorly insulated windows and doors can be a major source of heat loss in homes. Drafts and cold temperatures near windows and doors are uncomfortable for occupants of the home and waste energy by requiring a furnace or other heating appliance to compensate for the loss of heat. Prior art methods of insulating windows and doors are flimsy and difficult to install. Furthermore, prior art insulation cannot be reused after removal.

SUMMARY

According to one aspect of the disclosure, a kit for sealing an architectural opening, such as a window or a door, is provided. The kit includes a clear, flexible, vinyl sheet having a thickness of at least 1 millimeter and a magnetic strip. An adhesive backing extends along one side of the magnetic strip such that the magnetic strip is adhesively mountable to the vinyl sheet. The kit enables a consumer to easily seal the architectural opening by adhering the magnetic strip to the vinyl sheet, and then magnetically attaching the sheet over the architectural opening, thereby sealing the opening.

The vinyl sheet provided herein is easier to handle and more durable than prior art insulating films. The magnetic strip provides a tight seal while also enabling the sheet to be removed from the architectural opening without damaging either the sheet or the magnetic strip, thereby enabling re-use and re-attachment of the sheet over the architectural opening after removal.

A corresponding method of use is also provided.

A corresponding headrest cover and a method of use are also provided. The above features and advantages and other features and advantages of the present disclosure are readily apparent from the following detailed description of the best modes for carrying out the disclosure when taken in connection with the accompanying drawings.

DESCRIPTION OF THE PREFERRED EMBODIMENTS

Figure 1:
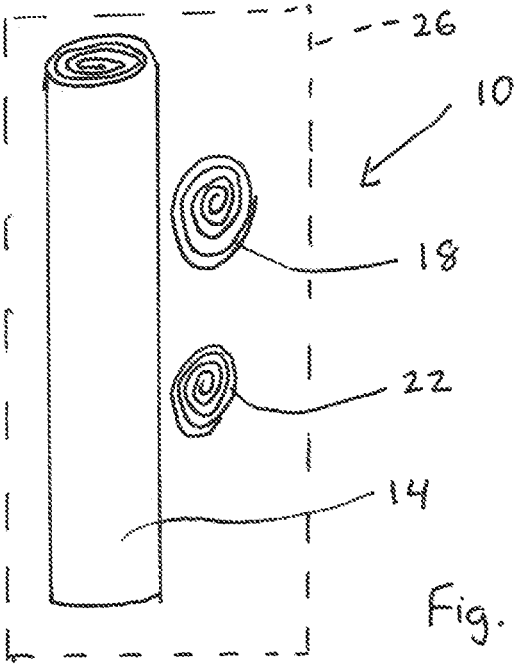
FIG. 1 is a schematic, side view of a kit including a vinyl sheet in roll form and two magnetic strips in coiled form.

Referring to FIG. 1, a kit 10 is schematically depicted. The kit 10 in the embodiment depicted includes a clear, i.e., substantially transparent, flexible, vinyl (polyvinyl chloride) sheet 14, a first magnetic strip 18, and a second magnetic strip 22. The kit 10 includes packaging 26 to interconnect the sheet 14 and strips 18, 22 as a unit for transportation and sale. For example, and without limitation, the packaging 26 may be a box defining an interior compartment that contains the sheet 14 and strips 18, 22; the packaging 26 may be a piece of material such as cardboard or plastic to which the sheet 14 and strips 18, 22 are connected such as by twist ties; etc.

Figure 2:
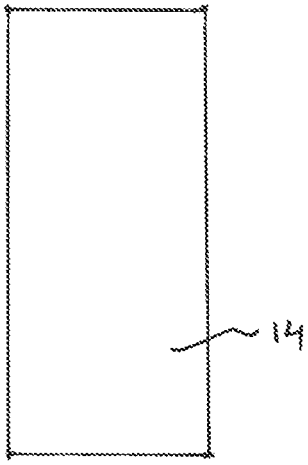
FIG. 2 is a schematic, side view of the vinyl sheet of FIG. 1 in an unrolled configuration.
Figure 3:
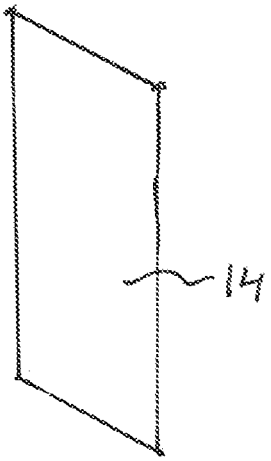
FIG. 3 is a schematic, perspective view of the vinyl sheet of FIGS. 1 and 2 in the unrolled configuration.

The sheet 14 when connected to or contained within the packaging 26 may be in roll form, i.e., rolled into a generally cylindrical shape, as shown in FIG. 1 so that the maximum dimensions are reduced for packaging efficiency. The sheet 14 is comprised of plasticized polyvinyl chloride, which is sometimes referred to as "flexible PVC" and "PVC-P" by those skilled in the art. Accordingly, the sheet 14 is sufficiently soft, flexible, and pliant such that the sheet 14 is easily unrolled to be generally planar as shown in FIGS. 2 and 3. More specifically, the vinyl sheet 14 includes sufficient plasticizer to make the sheet 14 soft, flexible, and foldable. The sheet 14 may also include other polymers mixed with PVC-P within the scope of the claimed invention. In alternative embodiments, the sheet 14 may be comprised of other polymers having mechanical properties similar to PVC-P.

Referring to FIGS. 2 and 3, wherein like reference numbers refer to like components from FIG. 1, the sheet 14, when unrolled and generally planar, is substantially rectangular, though other shapes may be employed within the scope of the claimed invention. In one embodiment, the sheet 14 has a thickness of at least 1 millimeter, and preferably at least 1.5 millimeters. In the embodiment depicted, the sheet 14 has a thickness of 1.52 millimeters. The length and width of the sheet 14 may vary, depending on intended use; in the embodiment depicted, the sheet has a length of 4,064 millimeters and a width of 1828.8 millimeters.

Figure 4:
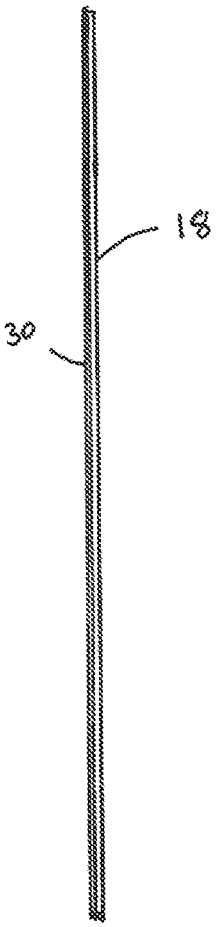
FIG. 4 is a schematic, side view of one of the magnetic strips in an uncoiled form.

Referring again to FIG. 1, the magnetic strips 18, 22 are coiled when connected to or contained within the packaging 26 as shown for packaging efficiency. The magnetic strips are sufficiently flexible such that each may be uncoiled and arranged substantially linearly, as shown in FIG. 4. Referring to FIG. 4, the first magnetic strip 18 is shown in a linear, uncoiled form. In the embodiment depicted, the length of the first magnetic strip 18 in uncoiled form is between 11 and 12 meters, the width is 12.7 millimeters, and the thickness is 2.54 millimeters, though other dimensions of the strip 18 may be employed within the claimed invention.

The first magnetic strip 18 includes an adhesive backing 30 on one side of the strip 18 as shown in FIG. 4. The second magnetic strip 22 is substantially identical to the first magnetic strip 18 in dimensions and also includes an adhesive backing.

Figure 5:
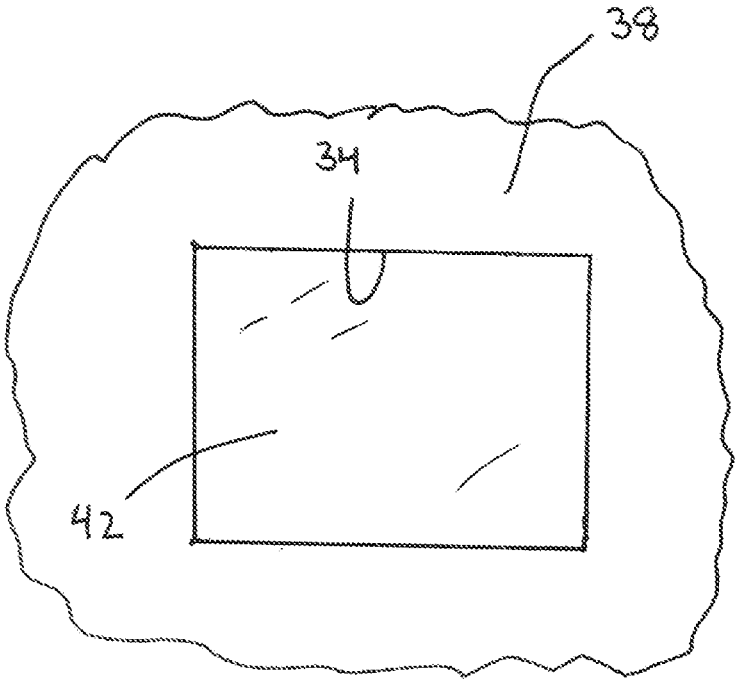
FIG. 5 is a schematic, side view of structure defining an architectural opening.

The kit 10 enables a user to easily provide a durable and re-usable covering for an architectural opening, such as the window opening shown at 34 in FIG. 5. Referring to FIG. 5, structure such as a wall 38 defines the window opening 34. A window 42 is disposed within the window opening 34. The window opening 34 may be the source of heat loss or drafts due to, for example, a poor seal between the wall 38 and the window 42 and/or a low insulation value of the material forming the window 42.

Figure 6:
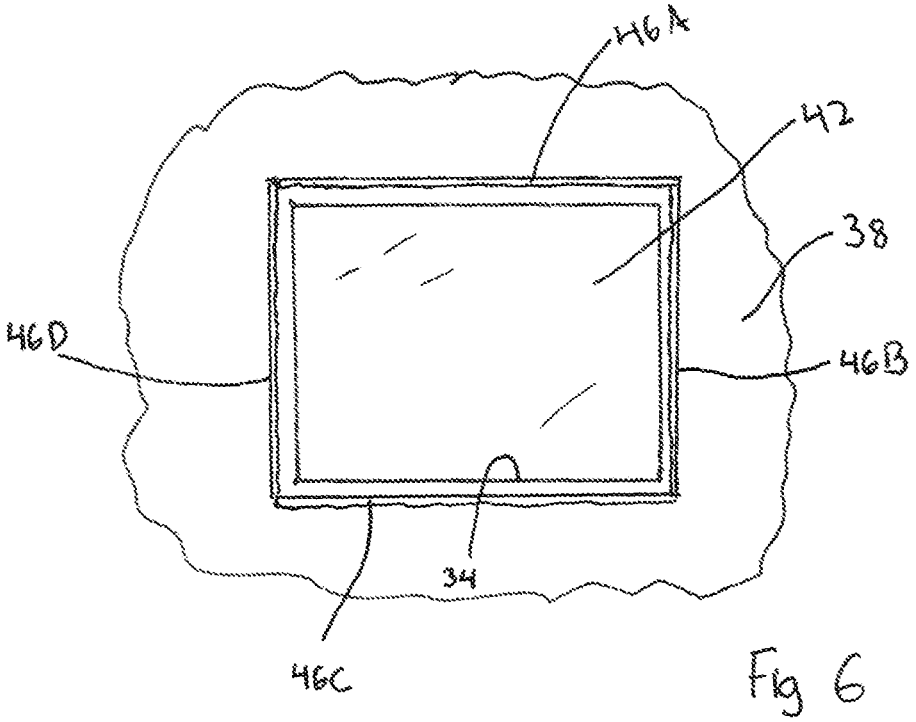
FIG. 6 is a schematic, side view of the structure of FIG. 5 with segments cut from one of the magnetic strips adhered thereto and surrounding the architectural opening.
Figure 7:
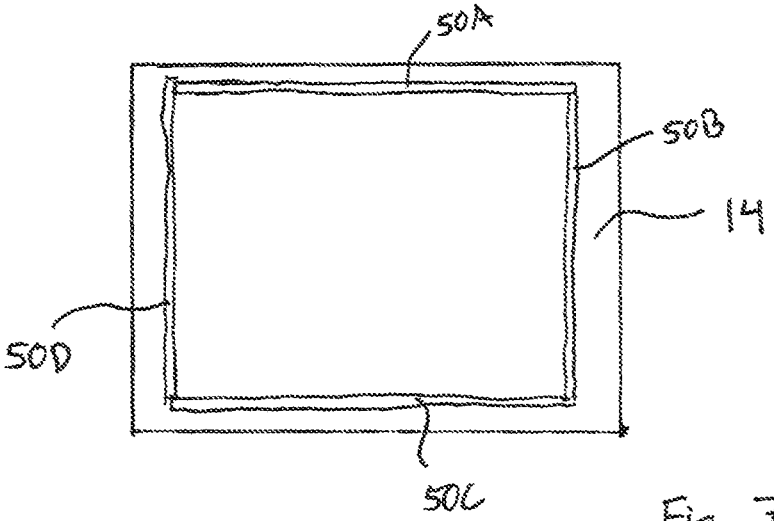
FIG. 7 is a schematic, side view of a portion of the vinyl sheet of FIGS. 1-3 with segments cut from the other of the magnetic strips adhered thereto in the same arrangement as the segments of FIG. 6.
Figure 8:
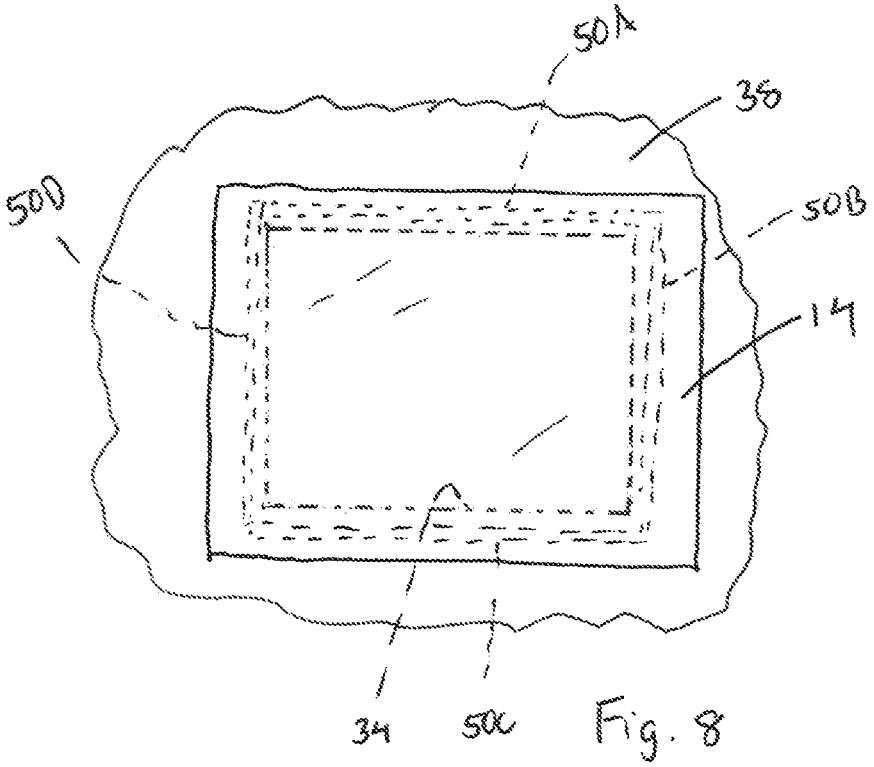
FIG. 8 is a schematic, side view of the structure of FIGS. 5 and 6 with the sheet covering the opening.

A method of using the kit 10 to cover the window opening 34 is depicted in FIGS. 6-8, wherein like reference numbers refer to like components from FIGS. 1-5. Referring to FIG. 6, the method may include cutting the second magnetic strip 22 into a plurality of segments 46A, 46B, 46C, 46D. The segments 46A-D of the second magnetic strip 22 are of sufficient length such that they can be arranged to surround the opening 34. The method may also include adhering the segments 46A-D to the wall 38 using the adhesive backing such that the segments 46A-D substantially surround the opening 34 as shown in FIG. 6.

Referring specifically to FIG. 7, the method also includes cutting the first magnetic strip 18 into a plurality of segments 50A, 50B, 50C, 50D. The segments 50A-D of the first magnetic strip are of sufficient length so that the segments 50A-D can have substantially the same arrangement as segments 46A-D. More specifically, segments 46A-D cooperate to define a shape having dimensions; the method includes adhering the segments 50A-D to the vinyl sheet 14 as shown in FIG. 7 so that segments 50A-D cooperate to form substantially the same shape with substantially the same dimensions. The method may include uncoiling the strips 18, 22 as needed to measure and cut the segments 46A-D and 50A-D. The method may also include unrolling the sheet 14 and removing material from the sheet 14 (such as by cutting) so that the sheet 14 is only slightly larger than the window opening.

Referring to FIG. 8, the method further includes placing the sheet 14 over the window opening 34 such that the magnetic attraction of the segments 50A-D of the first magnetic strip 14 for the segments 46A-D of the second magnetic strip 22 retains the sheet 14 with respect to the wall 38. The sheet 14 covers the opening, and the magnetic strip segments 46A-D, 50A-D cooperate to substantially seal the space between the sheet 14 and the wall 38.

More specifically, in the embodiment depicted, each segment 50A-D is in continuous contact with a corresponding one of segments 46A-D along their entire lengths. It should be noted that the adhesive backing of strip 18 is positioned on one of the north or south poles of the strip 18, and the adhesive backing of strip 22 is positioned on the other of the north or south poles of the strip 22 to ensure that opposite poles are exposed and segments 50A-D are attracted to segments 46A-D.

It should be noted that the second magnetic strip 22 may not be employed within the scope of the claimed invention. For example, if the structure around the window opening is comprised of ferrous material or is covered with magnetic paint, the second strip 22 is not necessary and the segments 50A-D of the first magnetic strip 18 will be sufficiently attracted to the structure to retain the sheet 14.

While the best modes for carrying out the invention have been described in detail, those familiar with the art to which this invention relates will recognize various alternative designs and embodiments for practicing the invention within the scope of the appended claims.

The invention claimed is:

1. A kit for sealing an architectural opening having a window therein, the kit consisting essentially of:

a clear, plasticized polyvinyl chloride sheet having a thickness of at least 1 millimeter;

a first magnetic strip, said first magnetic strip being coiled;

a second magnetic strip, said second magnetic strip being coiled;

adhesive that extends along one side of the first magnetic strip such that the first magnetic strip is adhesively mountable to the clear, plasticized polyvinyl chloride sheet;

adhesive on one side of the second magnetic strip; and packaging that holds or contains the clear, plasticized polyvinyl chloride sheet, the first magnetic strip, the second magnetic strip, and the adhesive.

2. The kit of claim 1, wherein the clear, plasticized polyvinyl chloride sheet is rolled into a generally cylindrical shape.

3. The kit of claim 1, wherein the clear, plasticized polyvinyl chloride sheet has a thickness of at least 1.5 millimeters.

4. A method of insulating an architectural opening, said architectural opening being defined by structure and having a window within the opening, the method comprising:

possessing a kit, the kit including a clear, flexible vinyl sheet having a thickness of at least 1.5 millimeters, a first magnetic strip being coiled and having adhesive that extends along one side of the first magnetic strip such that the first magnetic strip is adhesively mountable to the clear, flexible vinyl sheet, a second magnetic strip being coiled and having adhesive that extends along one side of the second magnetic strip such that the second magnetic strip is mountable to the structure, and packaging that holds or contains the clear, flexible vinyl sheet, the first magnetic strip, the second magnetic strip, and the adhesive;

adhering at least part of the first magnetic strip to the clear, flexible vinyl sheet; and mounting the clear, flexible vinyl sheet to the structure using magnetic attraction of the first magnetic strip such that the clear, flexible vinyl sheet covers the architectural opening.

5. The method of claim 4, further comprising cutting the clear, flexible vinyl sheet to change the size or shape of the clear, flexible vinyl sheet.

6. The method of claim 4, further comprising cutting the first magnetic strip into a first plurality of segments; and wherein adhering at least part of the first magnetic strip to the clear, flexible vinyl sheet includes adhering the first plurality of segments to the clear, flexible vinyl sheet.

7. The method of claim 6, wherein the method includes adhering at least part of the second magnetic strip to the structure around the architectural opening.

8. The method of claim 7, further comprising cutting the second magnetic strip into a second plurality of segments; and wherein adhering at least part of the second magnetic strip to the structure around the architectural opening includes adhering the second plurality of segments around the architectural opening.

* * * * *